US011118829B2

(12) United States Patent
Campbell

(10) Patent No.: US 11,118,829 B2
(45) Date of Patent: Sep. 14, 2021

(54) LOCK TO HOLD A COOLER LID IN AN OPEN POSITION, AND RELATED METHODS AND SYSTEMS

(71) Applicant: Cordova LLC, Nampa, ID (US)

(72) Inventor: Scott Campbell, Meridian, ID (US)

(73) Assignee: Cordova Outdoors LLC, Nampa, ID (US)

( * ) Notice: Subject to any disclaimer, the term of this patent is extended or adjusted under 35 U.S.C. 154(b) by 47 days.

(21) Appl. No.: 16/308,788

(22) PCT Filed: Jun. 14, 2017

(86) PCT No.: PCT/US2017/037570

§ 371 (c)(1),
(2) Date: Dec. 10, 2018

(87) PCT Pub. No.: WO2017/218715

PCT Pub. Date: Dec. 21, 2017

(65) Prior Publication Data

US 2019/0331391 A1 Oct. 31, 2019

Related U.S. Application Data

(60) Provisional application No. 62/350,543, filed on Jun. 15, 2016.

(51) Int. Cl.

| | |
|---|---|
| ***F25D 3/08*** | (2006.01) |
| ***B65D 43/16*** | (2006.01) |
| ***B65D 43/24*** | (2006.01) |

(52) U.S. Cl.

CPC ..... *F25D 3/08* (2013.01); *B65D 43/163* (2013.01); *B65D 43/24* (2013.01); *B65D 2543/0025* (2013.01); *F25D 2323/02* (2013.01)

(58) Field of Classification Search

CPC ..... B65D 43/163; B65D 43/24; B65D 2543/0025; F25C 5/18; F25C 5/182;

(Continued)

(56) References Cited

U.S. PATENT DOCUMENTS 3,272,379 A * 9/1966 Driza ..... B65D 43/24 220/832

4,904,007 A 2/1990 Woodruff (Continued)

OTHER PUBLICATIONS

International Search Report from International Application No. PCT/US2017/037570 dated Nov. 9, 2017.

(Continued)

*Primary Examiner* — James N Smalley
*Assistant Examiner* — Madison L Poos
(74) *Attorney, Agent, or Firm* — Holland & Hart LLP

(57) ABSTRACT

A cooler for holding ice and other items includes a body defining a cavity operable to hold ice and other items, a lid, and a lock operable to hold the lid in an open position. The body has a first region that defines an opening and a second region. The lid is coupled with the second region of the body, and positionable to a closed position and to an open position. The lock includes a first component that extends from the body's second region, and a second component that extends from the lid. The first component and the second component are each configured to contact each other, when the lid is in the open position, to prevent the lid from moving toward the closed position, and to allow the lid to move toward the open position, when the lid is in the closed position.

12 Claims, 3 Drawing Sheets

(58) Field of Classification Search
CPC ..... F25D 23/028; F25D 2323/02; F25D 2400/10; F25D 3/08; E05D 1/04; E05D 1/06; E05D 11/06
USPC ..... 220/592.01, 592.02, 592.03, 832
See application file for complete search history.

(56) References Cited

U.S. PATENT DOCUMENTS

| | | | |
|---|---|---|---|
| 5,337,911 | A | 8/1994 | Holub |
| 6,513,195 | B2 | 2/2003 | Haase et al. |
| 9,272,820 | B2 | 3/2016 | Cowie |
| 2002/0005411 | A1 | 1/2002 | Asami |
| 2003/0019873 | A1 | 1/2003 | Nam et al. |

OTHER PUBLICATIONS

Written Opinion from International Application No. PCT/US2017/037570 dated Nov. 9, 2017.

* cited by examiner

LOCK TO HOLD A COOLER LID IN AN OPEN POSITION, AND RELATED METHODS AND SYSTEMS

CROSS REFERENCE TO RELATED APPLICATION AND CLAIM OF PRIORITY

This application claims priority from commonly owned U.S. Provisional Patent Application 62/350,543 filed 15 Jun. 2016, and titled "Positionable Lid for a Cooler, and Related Systems and Methods", presently pending and incorporated by reference.

BACKGROUND

Many people use a cooler to keep food and/or drinks cool while outdoors. For example, many people pack a cooler with food and drinks and then take the cooler with them while they spend time in a boat on a lake, river or ocean; or in a car on a road trip; or camping outdoors. The cooler allows them to pack food that would otherwise spoil and to keep drinks cool that would otherwise warm, which allows them to stay out on the water, on a drive, or at a campsite for a longer period of time.

Coolers typically have a body that includes a cavity where the ice, food and/or drinks are held, and a lid that covers the cavity when access to the ice, food and/or drinks in the body's cavity is not wanted. When the lid covers the body's cavity, the lid is in the closed position and helps prevent heat from outside the cooler from warming the ice, food and/or drinks held in the cavity. When the lid does not completely cover the body's cavity, the lid is in an open position and allows one to gain access to the ice, food and/or drinks held in the cavity. Some coolers include a lid that is not attached to the body. With such coolers, one simply separates the lid from the body when one wants to open the cooler. With such coolers, one can easily misplace, and thus lose, the lid when one opens the cooler, or when one stores the cooler for a period of time.

Some coolers include a lid that is attached to the body. With such coolers, one moves the lid relative to the body to open the cooler, but one does not separate the lid from the body. Although such coolers make it much more difficult to lose the cooler's lid, it can be more difficult to open and keep open the lid of such coolers. Typically, the lid pivots about a hinge that is mounted to the body. Because the lid pivots about the axis of the hinge, the lid has to be rotated about the axis over 90 degrees so that the lid will remain in the open position after one releases one's grip of the lid. If the lid were only allowed to rotate less than 90 degrees, the lid would fall back toward the closed position after one releases it. This can be problematic when one locates the cooler in small space such as under the seat of boat because in such a location the seat and/or backrest prevent one from rotating the cooler's lid more than 90 degrees.

Thus, there is a need for a cooler whose lid may be locked in an open position that is less than 90 degrees relative to the opening of the cavity.

SUMMARY

In an aspect of the invention, a cooler for holding ice and other items includes a body defining a cavity operable to hold ice and other items, a lid, and a lock operable to hold the lid in an open position. The body has a first region that defines an opening through which the cavity may be accessed, and a second region. The lid is coupled with the second region of the body, and positionable, relative to the opening defined by the first region, to a closed position that covers the body's opening and prevents access to items held in the body's cavity, and to an open position that uncovers the body's opening and allows access to the items held in the body's cavity. The lock includes a first component that extends from the body's second region, and a second component that extends from the lid. The first component and the second component are each configured to contact each other, when the lid is in the open position, to prevent the lid from moving toward the closed position, and to allow the lid to move toward the open position, when the lid is in the closed position.

With the cooler's lock, the lid may be moved to an open position that is less than 90 degrees relative to the cavity's opening and held in that position. Thus, one can store the cooler in a small place that would otherwise be avoided. In addition, with the lid held by the lock at an open position, a breeze or inadvertent movement of the cooler will not cause the lid to move toward the closed position.

In another aspect of the invention, a method for holding a lid of a cooler in an open position, includes: a) contacting a first component of a lock with a second component of the lock when a lid of the cooler is at an open position that allows access to items held in a cavity defined by a body of the cooler, wherein the first component extends from the body, adjacent to where the lid is coupled with the body, and the second component extends from the lid, and b) preventing the lid from moving toward a closed position that prevents access to the items held in the body's cavity.

DETAILED DESCRIPTION

Figure 1:
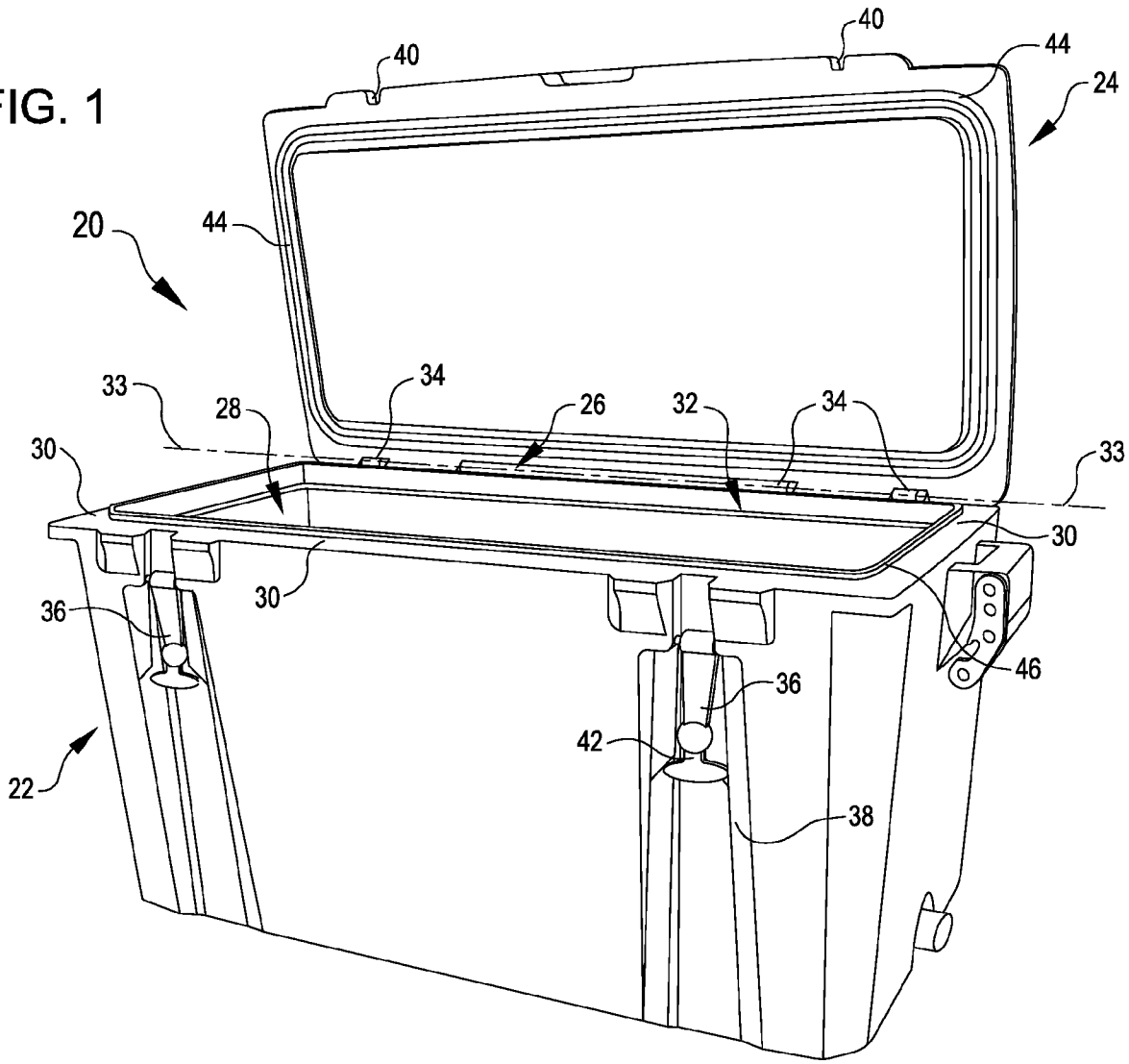
FIG. 1 shows a perspective view of a cooler, according to an embodiment of the invention.
Figure 2A:
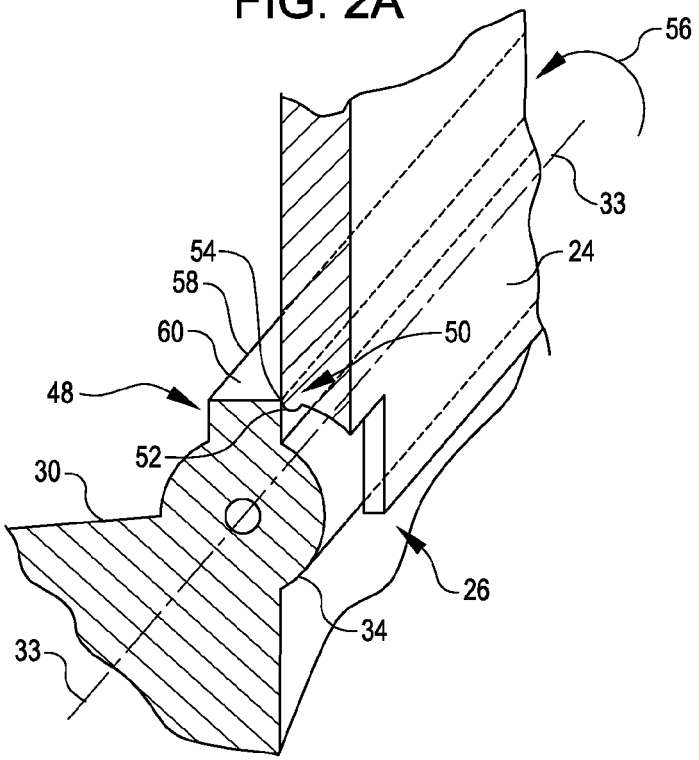
FIG. 2A shows a cross-sectional view of a lock of the cooler shown in FIG. 1 holding the lid of the cooler in an open position, according to an embodiment of the invention.
Figure 2B:
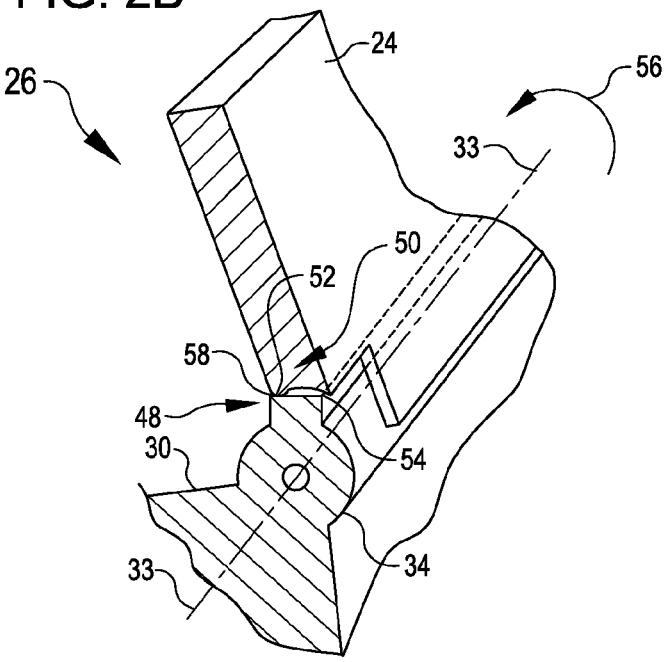
FIG. 2B shows a cross-sectional view of the lock of the cooler shown in FIG. 1 holding the lid of the cooler in another open position, according to an embodiment of the invention.

FIG. 1 shows a perspective view of a cooler 20, according to an embodiment of the invention. The cooler 20 includes a body 22, a lid 24 that is moveable relative to the body 22 from a closed position (not shown) to an open position (shown), and a lock 26 that, when engaged, holds the lid 24 in the open position. As discussed in greater detail below and in conjunction with FIGS. 2A and 2B, the lock 26 may hold the lid 24 at one or more open positions (here two as shown in FIGS. 2A and 2B), and one or more of the open positions may be less than 90 degrees relative to the body 22, such that the lid 24 remains extended over the body 22 when in the open position.

With the cooler's lock 26, one may move the lid 24 to an open position that is less than 90 degrees relative to the cooler's body, engage the lock 26 to hold the lid in the open position, and then reach into the cooler's body without having to use one's hand, elbow, or leg to keep the lid 24 at the open position. Thus, one can store the cooler in a small place that would otherwise be avoided because of the inconvenience of having to hold the lid open while accessing items held in the cooler's body. In addition, with the lock 26 holding the lid 24 in an open position, a breeze or inadvertent movement of the cooler, such as when a boat encounters a wave or when a car encounters a bump in the road, will not cause the lid 24 to move toward the closed position.

Still referring to FIG. 1, the body 22 defines a cavity 28 in which one may place one or more items, such as ice, food and/or drinks, to hold the items and keep them cool relative to the temperature outside the cooler. The body 22 has a first region 30 that defines an opening 32 through which the cavity 28 may be accessed, and a second region 34. In this and other embodiments, the opening 32 lies in a flat plane. In yet other embodiments, the opening may lie in a curved plane (a plane that extends in three dimensions, not two). The lid 24 is coupled with the second region 34 of the body 22, and moveable, relative to the opening 32 defined by the first region 30, about an axis 33, to two or more positions. One of the positions is a closed position in which the lid 24 covers the opening 32 and prevents access to items held in the cavity 28. Another of the positions is an open position that uncovers the opening 32 and allows one access to the items held in the cavity 28.

To be clear, an open position is any position of the lid 24 relative to the opening 32 that is not the closed position. Thus, the number of open positions that exist between the lid being in the closed position and the lid being in the open position where the lid is more than 90 degrees relative to the opening 32, is infinite. The lock 26 may hold the lid 24 at any desired open position. For example, in this and other embodiments, the lock 26 holds the lid 24 in two open positions. One of the open positions is where the lid 24 is located 70 degrees relative to the opening 32 (see FIG. 2B), and the other open position is where the lid 24 is located 90 degrees relative to the opening 32 (see FIG. 2A). In other embodiments, the lock 26 may hold the lid 24 at an open position that is less than 70 degrees relative to the opening 32. In still other embodiments, the lock 26 may hold the lid 24 at an open position that is greater than 70 degrees, or even 90 degrees. In yet other embodiments, the lock 26 may hold the lid 24 at a single open position that is between the closed position and 90 degrees relative to the opening 32; or the lock 26 may hold the lid 24 at three or more open positions, one or more of which is less than 90 degrees relative to the opening 32.

The lock 26 may or may not hold the lid 24 in the closed position. In some embodiments, the lock 26 does hold the lid 24 in the closed position. But, in this and other embodiments, the lock 26 does not hold the lid 24 in the closed position. Instead, the cooler 20 includes a latch 36 (here two) that secures the lid 24 in the closed position. Each latch 36 is coupled to the body 22 near the opening 32 with a pin (reference number omitted) so that the latch 36 may rotate about the pin to lock the lid 24 in the closed position. Because the lid 24 is shown in FIG. 1 in an open position, the latch 36 hangs down from the pin, away from the opening 32. To lock the lid 24 in the closed position, one grabs the end 38 of one or both of the latches 36 and rotates the latch 36 so that the end 38 lies adjacent the notch 40 in the lid 24 (here about 180 degrees). Then, one inserts the neck 42 of the latch 36 into the notch 40. In this and other embodiments, the latch 36 has an elastic body so that when the neck 42 lies in the notch 40, the end 38 exerts pressure on the lid 24 toward the pin that couples the latch 26 with the body 22, and thus holds the lid 24 in the closed position.

Still referring to FIG. 1, the lid 24 may include a seal 44 that contacts a lip 46 when the lid is in the closed position. When in contact with the lip 46, the seal 44 prevents air from outside the cooler 20 from entering the cavity 28. This helps keep the temperature in the cavity 32 colder than the temperature outside the cooler 20. In this embodiment, the seal 44 surrounds the opening 32 when the lid 24 is in the closed position. In addition, the seal 44 is elastic so that the seal 44 can accommodate minor irregularities in the lip 46 to maintain good contact with the lip 46 and prevent air from outside the cooler 20 from entering the cavity 32.

The body 22, lid 24 and lock 26 may include any desired material and may be made using any desired manufacturing technique. For example, in this and other embodiments, the body 22, lid 24 and lock 26 include polyethylene and are rotoformed. Rotoforming is a technique that includes placing an amount of material into a mold and securely closing the mold. The mold and enclosed material is then heated and rotated about both a horizontal and vertical axis, for a period. During this period, the material fuses together and lines the inside of the mold. Next, the material inside the mold is cured, and then released from the mold. By rotoforming the body 22, lid 24 and lock 26, each of these may be efficiently manufactured, especially if each have a portion that includes an undercut or sharp change in contour.

Each of FIGS. 2A and 2B shows a cross-sectional view of the lock 26, according to an embodiment of the invention. FIG. 2A shows the lock 26 holding the lid 24 at an open position that is 90 degrees relative to the opening 32. FIG. 2B shows the lock 26 holding the lid 24 at an open position that is 70 degrees relative to the opening 32.

The lock 26 may be configured as desired to hold the lid in an open position that is 90 degrees or less relative to the opening 32. For example, in this and other embodiments the lock 26 includes a first component 48 that extends from the second region 34 of the cooler's body 22, and a second component 50 that extends from the lid 24. The first and second components 48 and 50, respectively, are configured to contact each other when the lid is in one of the desired open positions, i.e. 90 degrees and 70 degrees relative to the opening 32, to prevent the lid 24 from moving toward the closed position. As previously discussed, the open position that the lock 26 may hold the lid at may be any one or more desired open positions. When the lid 24 is not at one of the desired open positions, the first and second components 48 and 50, respectively, do not contact each other to allow the lid 24 to move toward a desired open position or toward the closed position.

More specifically, in this and other embodiments the second component 50 has a triangular shape whose apex 52 is rounded, such that in cross-section the second component is similar to the cross-section of a lobe of an internal combustion engine's camshaft. The lobe of the camshaft is the portion of the camshaft that pushes a poppet valve open to allow gases into or out of the engine's cylinder. The first component 48 has a rectangular shape such that in cross-section a first corner 54 contacts the apex 52 of the second component 50 to prevent the lid 24 at the 90-degree open position from rotating in the direction indicated by the arrow 56 (toward the closed position). The first component 48 also has a second corner 58 that contacts the apex 52 of the second component 50 to prevent the lid 24 at the 70-degree open position from rotating in the direction indicated by the arrow 56 (see FIG. 2B). Because the lid 24 rotates about the axis 33 when the lid 24 is moved among the closed and open positions, the apex 52 of the second component 50 does not contact the portion 60 of the first component 48 that lies between the first and second corners 54 and 58, respectively.

Other embodiments are possible. For example, the first and second components 48 and 50, respectively, may be attached to their respective body 22 and lid 24, not formed in each as each is manufactured. In such embodiments, the first component 48 may be releasably attached to the body 22 with one or more screws and/or adhesive, and the second component 50 may also be releasably attached to the lid 24 by one or more screws and/or adhesive. In another example, the cross-section of the first component may have any shape other than a rectangle. Likewise, the cross-section of the second component may have any shape other than a triangle with a rounded apex.

The location of the lock's first component 48 around the circumference of the body's second region 34 and the distance between the first and second corners 54 and 58, respectively, establishes the two desired open positions of the lid 24 that the lock 26 holds the lid 24 at. For example, in this and other embodiments the location of the first component 48 may establish the location of a first open position (here the 90-degree open position) that provides a greater degree of access to the body's cavity than a second open position (here the 70-degree open position). And the distance between the first and second corners 54 and 58 may establish the location of the second open position. So, when the location of the first component 48 is set (here extending 90 degrees relative to the opening 32 (FIG. 1)), increasing the distance between the first and second corners 54 and 58, respectively, increases the angular distance between the first and second open positions. To establish a different set of first and second open positions, such as a first open position being 60 degrees relative to the opening 32 and a second open position being 45 degrees relative to the opening 32, the first component 48 may be clocked about the axis 33 in the direction indicated by the arrow 56 so that it extends away from the second region at an angle that is not 90 degrees relative to the opening 32. And, the distance between the first and second corners 54 and 58, respectively, may be less than the distance between these corners as shown in FIGS. 2A and 2B.

Still referring to FIGS. 2A and 2B, in this and other embodiments, the apex 52 of the second component 50 is less stiff than the first and second corners 54 and 58, respectively, so that when one urges the lid 24 to rotate in the direction indicated by the arrow 56 or the opposite direction, the second component 50 deforms more than the first and second corners 54 and 58, respectively. This causes the second component 50 to suffer most, if not all, of the wear that the lock 26 experiences over its life, which allows one to more easily repair the cooler 20 by replacing the lid 24, not the body 22. In other embodiments, the apex 52 of the second component 50 may be stiffer than the first and second corners 54 and 58, respectively, of the first component 48. In still other embodiments, the apex 52 and the corners 54 and 58 may each have the same stiffness.

Figure 3:
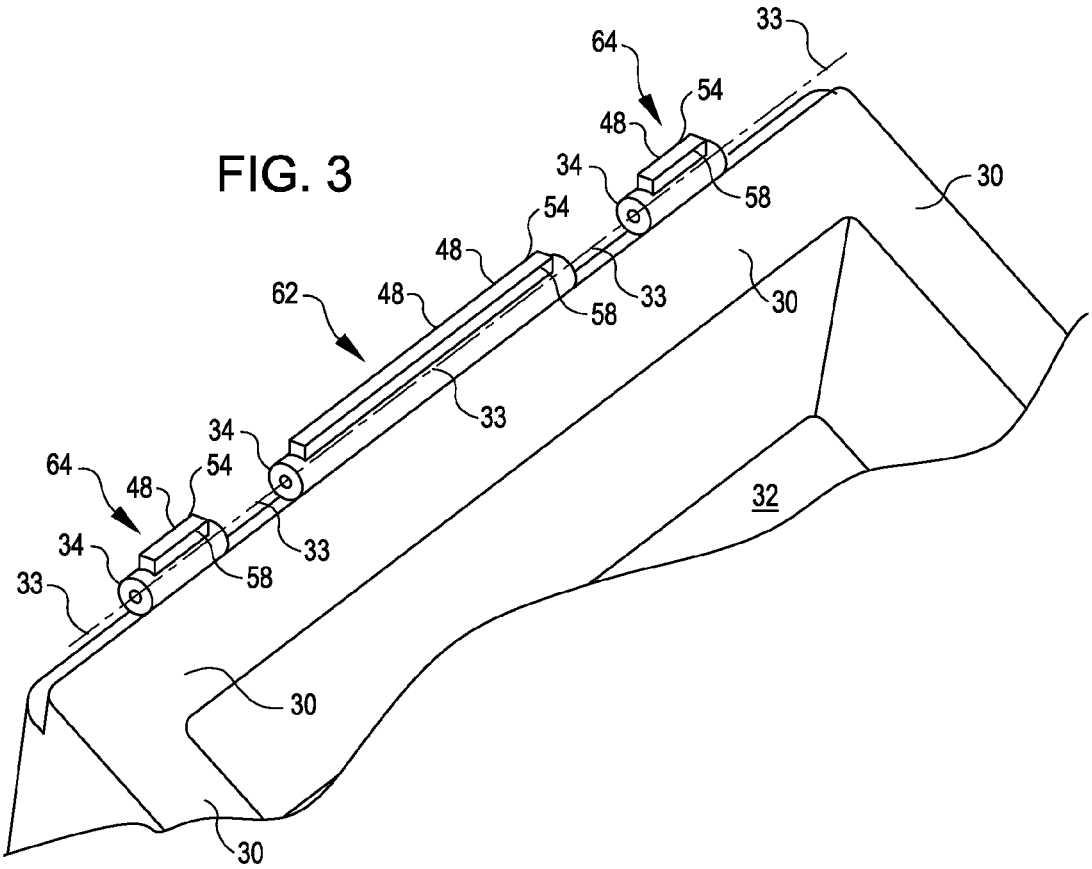
FIG. 3 shows a perspective, partial view of the body of the cooler shown in FIG. 1, according to an embodiment of the invention.

FIG. 3 shows a perspective, partial view of the cooler's body 22 with the lock's first component 48 extending along the body's second region 34, according to an embodiment of the invention. The lock 26 may extend any length along the body's second region 34 in the direction of the axis 33. For example, in this and other embodiments the lock's first component 48 and the lock's second component 50 (not shown) extend the same distance along the axis 33, which is greater than half of the length of the lid 24 in the same direction. By having the lock's first and second components 48 and 50, respectively, extend a substantial distance along the axis 33, a substantial amount of force is required to release the lock 26, and thus the lock 26 may effectively hold the lid 24 in one of the desired open positions in more windy conditions or during rougher rides in a boat or car.

Other embodiments are possible. For example, the first component 48 of the lock 26 may extend less distance along the axis 33 than the second component 50, or vice-versa.

As previously discussed in conjunction with FIGS. 2A and 2B, the location of the lock's first component 48 helps dictate the location of the desired open positions for the lid 24. To provide more than two desired open positions that the lock 26 holds the lid 24 at, the location of the first component 48 around the circumference of the body's second region may change as the first component 48 extends along the axis 33. For example, the long portion 62 of the lock's first component 48 may extend from the body's second region 34 as shown in FIGS. 2A and 2B to provide the 90-degree and 70-degree open positions. And, the short portions 64 of the lock's first component 48 may extend from the body's second region 34 as discussed above to provide a 60-degree and 45-degree open position. In such an embodiment, the distance between the first and second corners 54 and 58, respectively, in the short portions 64 of the lock's first component 48 are less than the distance between the first and second corners 54 and 58, respectively, in the long portion 62 of the lock's first component 48.

Figure 4:
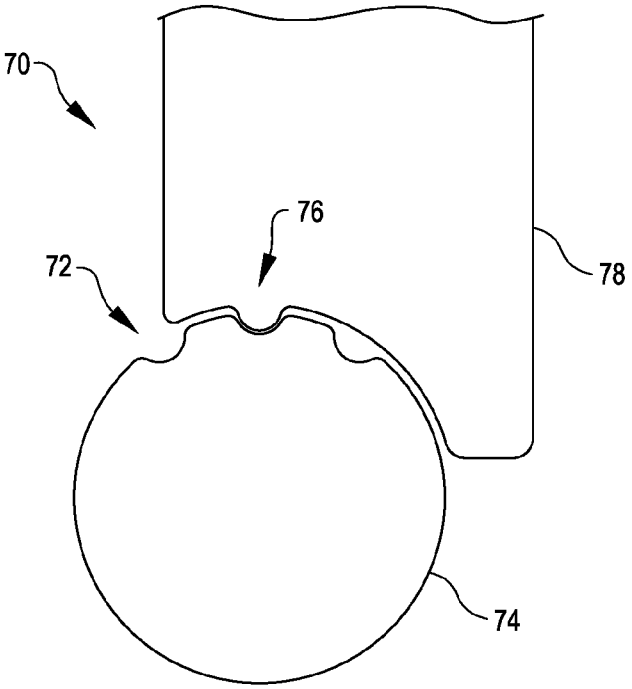
FIG. 4 shows a view of a lock, according to another embodiment of the invention.

FIG. 4 shows a view of a lock 70, according to another embodiment of the invention. The lock 70 is similar to the lock 26 shown in FIGS. 1-3, except the first component 72 that extends from the cooler body's second region 74, and the second component 76 that extends from the lid 78 maintain contact with each other as the lid 24 rotates from the closed position toward the desired open positions, and vice-versa. In addition, the lock 70 holds the lid 78 in three desired open positions, one of which locates the lid 78 more than 90 degrees away from the cooler body's opening.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A cooler for holding ice and other items, the cooler comprising:

a body defining a cavity operable to hold items, the body having:

a first region that defines an opening through which the cavity may be accessed, and a second region;

a lid coupled with the second region of the body, and rotatable about an axis, relative to the opening defined by the first region, to:

a closed position that covers the opening of the body and prevents access to the cavity of the body, a first open position that uncovers the opening of the body and allows access to the cavity of the body, and a second open position that uncovers the opening of the body and allows access to the cavity of the body; and a lock operable to hold the lid in at least the first open position and the second open position, the lock having:

a first component that extends along the second region in a first direction that is parallel to the axis, wherein the first component includes a first corner that extends in the first direction and a second corner that extends in the first direction, a second component that extends from the lid in the first direction that is parallel to the axis, wherein the second component includes an apex that extends in a second direction that is perpendicular to the axis, and wherein the apex of the second component is adapted to contact the first corner of the first component to hold the lid in the first open position and to contact the second corner of the first component to hold the lid in the second open position.

2. The cooler of claim 1 wherein when the lid is in the closed position the lid contacts the first region and seals the cavity.

3. The cooler of claim 1 wherein the first corner is separated from the second corner by a distance, and the first open position of the lid differs from the second open position of the lid, wherein the distance separating the first corner and the second corner defines a difference between the first open position and the second open position of the lid.

4. The cooler of claim 1 wherein the apex of the second component is less stiff than the first corner and the second corner.

5. The cooler of claim 1 wherein the first open position is 90 degrees relative to the opening, and the second open position is 70 degrees relative to the opening.

6. The cooler of claim 1 wherein the lid is coupled with the second region such that the lid pivots about the axis as the lid moves between the closed position and the first open position or the second open position.

7. The cooler of claim 1 wherein:

the first component extends in the first direction along the axis for a distance that is greater than half of a length of the lid.

8. The cooler of claim 1 wherein the first component includes a rectangular-shaped cross-section.

9. The cooler of claim 1 wherein the apex is rounded.

10. The cooler of claim 1 further comprising a latch operable to hold the lid in the closed position.

11. The cooler of claim 1, wherein the apex does not contact a portion of a surface of the first component that extends between the first corner and the second corner as the apex rotates around the axis.

12. A cooler for holding ice and other items, the cooler comprising:

a body defining a cavity operable to hold items, the body having:

a first region that defines an opening through which the cavity may be accessed, and a second region;

a lid coupled with the second region of the body, and rotatable about an axis, relative to the opening defined by the first region, to:

a closed position that covers the opening and prevents access to the cavity of the body, a first open position that uncovers the opening of the body and allows access to the cavity of the body, and a second open position that uncovers the opening of the body and allows access to the cavity of the body; and a lock operable to hold the lid in at least the first open position and the second open position, the lock having:

a first component that extends along the second region in a first direction that is parallel to the axis, wherein the first component includes a plurality of contours configured to receive an apex, the plurality of contours extending in the first direction, a second component that extends from the lid in the first direction that is parallel to the axis, wherein the second component includes at least one apex that extends in a second direction that is perpendicular to the axis, wherein the at least one apex on the second component is adapted to contact the plurality of contours of the first component to hold the lid in one of the first open position or the second open position.

* * * * *